US006168233B1

(12) United States Patent
Markus

(10) Patent No.: US 6,168,233 B1
(45) Date of Patent: Jan. 2, 2001

(54) RECLINABLE SEATING USING A TORSION BAR

(76) Inventor: Isidoro Natalio Markus, 65-36 99 St. (1E), Rego Park, NY (US) 11374-4363

( * ) Notice: Under 35 U.S.C. 154(b), the term of this patent shall be extended for 0 days.

(21) Appl. No.: 09/525,652

(22) Filed: Mar. 15, 2000

(51) Int. Cl.[7] ..... A47C 1/031

(52) U.S. Cl. ..... 297/302.3; 297/303.3; 297/326; 297/302.5

(58) Field of Search ..... 297/302.3, 303.3, 297/325, 326, 337, 302.5

(56) References Cited

U.S. PATENT DOCUMENTS 2,633,897 * 4/1953 Moore ..... 297/302.3
2,935,119 * 5/1960 Lie ..... 297/302.3 X
3,185,429 * 5/1965 Meinhardt ..... 297/302.3 X
3,989,297 * 11/1976 Kerstholt ..... 297/337 X
4,718,726 * 1/1988 Estkowshi et al. ..... 297/302.3 X
4,818,019 * 4/1989 Mrotz, III ..... 297/302.38 X

* cited by examiner

*Primary Examiner*—Peter R. Brown

(57) ABSTRACT

A four legged or sled chair having a reclinable seat comprising a frame structure, a seat mounted within the frame structure for pivoting about a transverse torsion bar(s) axis, and elastic stops defining said seat position of maximum rearward pivoting and the position of maximum forward pivoting in relation thereto.

8 Claims, 8 Drawing Sheets

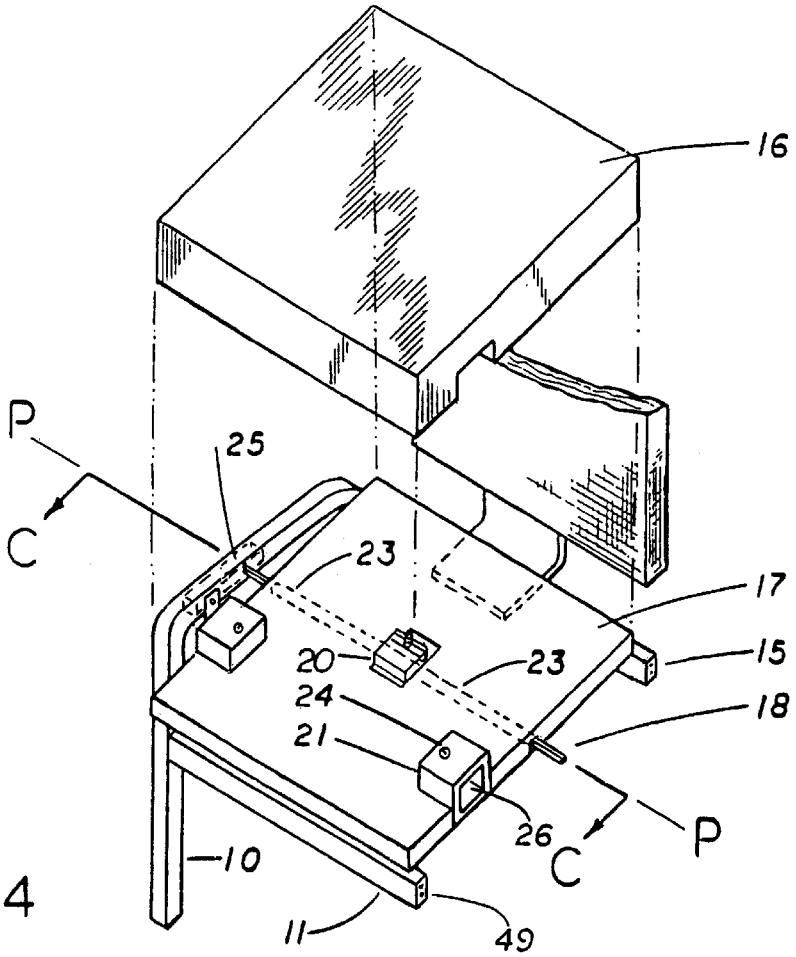
FIG. 4
FIG. 5
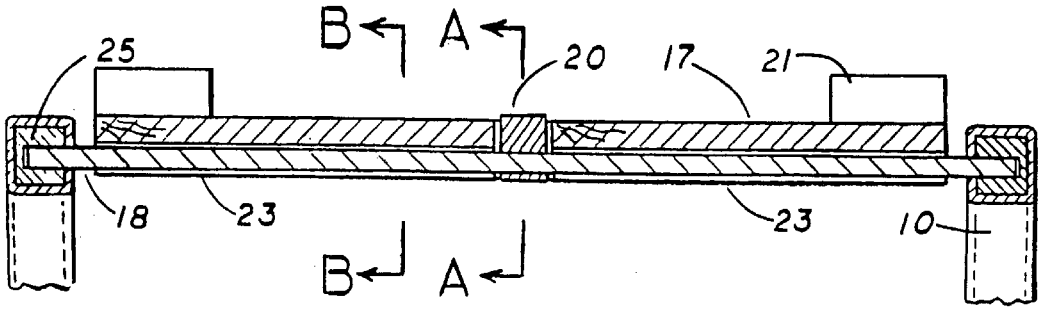

FIG. 6
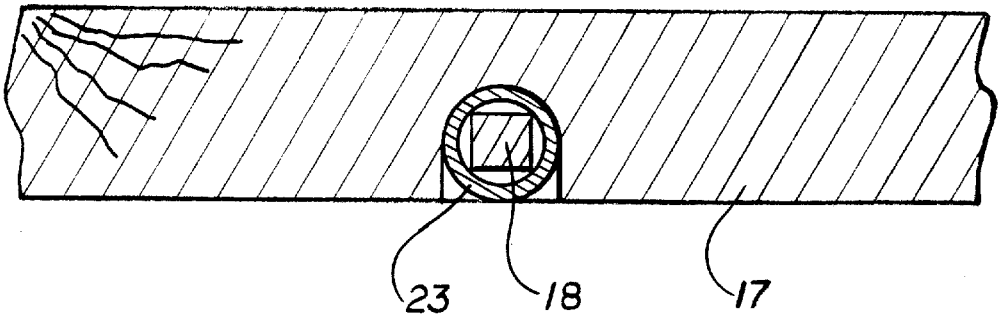
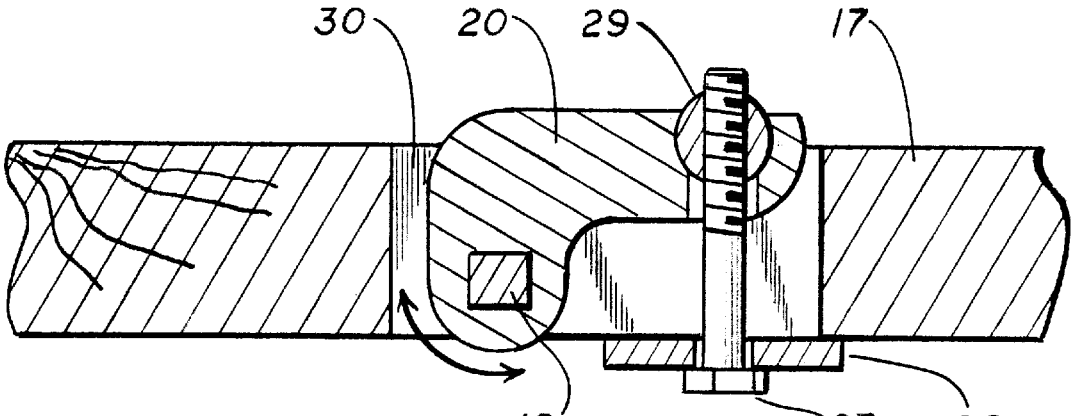
FIG. 7

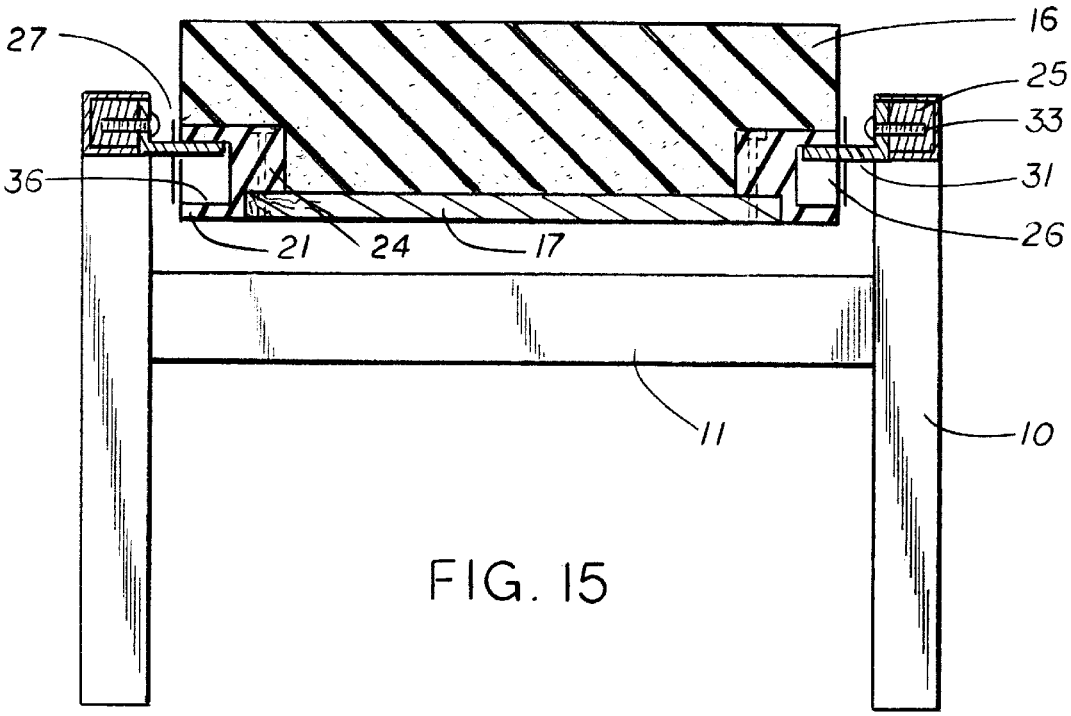
FIG. 15
FIG. 16
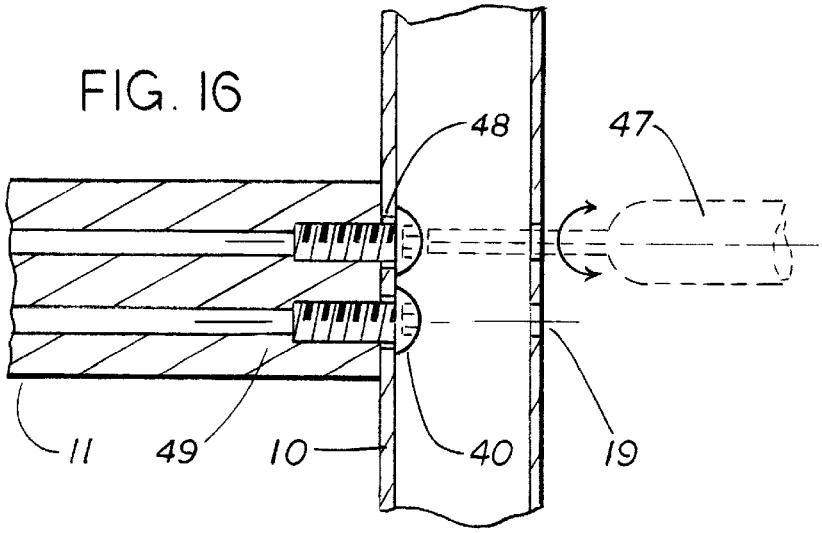

RECLINABLE SEATING USING A TORSION BAR

DESCRIPTION OF THE PRIOR ART

Chairs of the abstract description are unknown, but torsion bar chair controls for office-type chairs are common. When utilizing a torsion bar in an office-type chair, the elongated axis of the bar is usually located above the chair post, within a mechanism that also contains the seat rotation stops and the seat initial resiliency controls. Typical office chairs having a torsion bar mechanism are described in U.S. Pat. Nos. 3,136,580; 3,240,528 and 3,224,807. The only four legged chair known to the applicant that has a torsion bar, is disclosed in U.S. Pat. No. 4,938,532. In this chair the torsion bar, its bearings and a non-adjustable seat stop are mounted on an aluminum extrusion bar that is welded to the chair frame. Here the torsion bar is used to provide a flexible back support, only.

BACKGROUND OF THE INVENTION

The present invention relates to four legged and sled chairs of the type used in conference halls and restaurants. Said chairs always have a fixed seat; usually they don't have arm rests and are of a stackable type.

In this invention, the seat is supported and guided by a transverse torsion bar(s) so as to enable it to pivot, tilt or recline with respect to the chair frame, thereby enabling the user to rotate the seat position from upright (maximum forward) seating to a fully reclining (maximum rearward) seating, and vice versa. Thus, giving a pleasing sense of freedom and comfort to the occupant. The torsion bar(s), anchored to the chair frame and to the bottom seat board, provides the resilient torque that bias the seat to its upright position. Means attached to said bottom seat board engage travel limiting means placed in the side frame that would define the maximum forward and rearward rotation of said seat.

In the present state-of-the-art, only chairs having a vertical post with the ubiquitous spider base offers reclinable seating, all others have fixed seating —or at most— a tiltable back board. But those spider based chairs —though very comfortable— are too unsightly, expensive and/or cumbersome to move and to store-away, to be used in high density seating areas like restaurants, bingo parlors, auditoriums, etc.

In view of the shortcomings mentioned above, it is the principal object of the present invention to introduce a chair having a reclinable seat mounted on a four legged frame, or a sled frame, whereby said frame could be made of plastic, metal and/or wood. Yet, another object of the invention is to provide an inexpensive reclinable chair having enhanced aesthetics and comfort. A further object of the invention is to provide a simplified method of manufacturing and assembling such chairs.

BRIEF DESCRIPTION OF THE DRAWINGS

In the accompanying drawings:

FIG. 4 is an exploded partial perspective view of the bottom board of FIG. 1;

FIG. 5 is a sectional view of FIG. 4 taken along line C—C;

FIG. 6 is a schematic sectional view of FIG. 5, taken along line B—B;

FIG. 7 is a schematic sectional view of FIG. 5, taken along line A—A, showing the torsion bar control mechanism;

FIG. 15 is a sectional view illustrating the stop mechanism taken along line E—E of FIG. 2, and FIG. 16 is partial sectional view of FIG. 3 taken along line H—H showing the fastening of the side frame to the cross-rail.

DETAILED DESCRIPTION OF THE PREFERRED EMBODIMENTS

Figure 1:
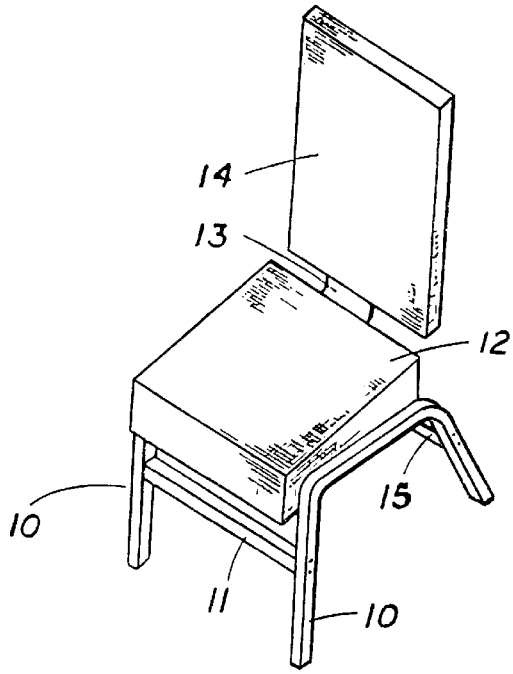
FIG. 1 is a perspective view of a four legged reclinable chair having a tubular frame according to the present invention.

Referring now in detail to the embodiments of the chair shown in FIG. 1 which comprises a supporting metal frame incorporating two similar square tubular side frames 10, each tubular element bent to provide a substantially horizontal member and substantially vertical leg members. A front cross-rail 11, and a rear cross-rail 15 connect both side frames in a spaced apart relationship.

The seat comprises an upholstered bottom board 12 and an upholstered back board 14 which are connected to each other at an obtuse angle by a flat spring 13. The seat pivot as a unit in response to a backward leaning movement of the chair occupant. The upholstery consist of contoured foam blocks that are glued to the bottom and back boards and are subsequently covered by a cloth, that in turn, is stapled to the wooden boards. It will be understood that the hardware is symmetrically disposed on both side of the chair; hence, the hardware on one side only will be described.

In the exploded perspective view of the bottom board 12, as shown in FIG. 4, the fabric covering the foam 16 is not shown, and the foam 16 that is placed in top of the wooden —or plastic— bottom board 17 have been vertically displaced for clarity. Shown in broken outline are the two tubes 23 through which passes the square section torsion bar 18. 21 is the elastic seat stop in the form of a block of material made of rubber, or covered with rubber, having an opening 26 facing the side frame, and a fastener 24 that connect it to the board 17.

In FIG. 5, the ends of the torsion bar 18 are securely engaged to inserts 25 that are placed inside the horizontal members of the side frames 10, while at a point intermediate within the bar ends an anchor 20 will transmit the torsion to the board 17, to which said anchor is engaged. Here, 23 are a pair of hardened steel cylindrical bushings placed and fastened into a kerf that runs across the board 17. Though the bushings 23 are shown placed underneath the board 17, they could as well be placed on top of the board, or within the board thickness, without changing their function. The two bushings 23 engage the torsion bar 18 to the bottom board 17 while allowing rotation thereof, hence, the seat is basically being supported and positioned from —and— by the torsion bar 18 ends; only with the seat in the upright position do the bracket 31 absorb some of the chair occupant weight. It is worth noting that once an initial torque is applied, the friction of the torque bar against the frame inserts 25, the bearings 23 and the anchor 20, are enough to eliminate any side motions of the bars and/or the seat relative to the frame.

The hardened steel tube 23 is shown here as a full length tubular bushing for the square bar 18, that is hardened and tempered. Innumerable tests has proven that such an arrangement have a long service life expectancy if the bar flats are placed horizontally, as shown in FIG. 6, and if the square bar edges were previously dulled. For the type of chairs described in this invention, the seat rotation between the upright and the fully reclined positions is about 10°, thus, the rotation of the square bar inside the tubes varies from almost zero at the point of insertion into the anchor 20, to about 10° at the outer edges of the seat. Taking in account the small forces involved, the large hardened bearing surfaces in play, the lubricants and the infrequent and relatively small rotation between the torsion bar and the tube, wear and friction proved to be insignificant.

In FIG. 7, the referral number 20 belongs to a rotatable anchor that is an aluminum extrusion having a complementary square opening to allow the tight passage of said rod 18 throughout. The rotatable anchor 20 is located in the opening 30, a cut out in the center of the wooden board 17. The chair assembly procedure is to insert the rod 18 through the pivotably anchor 20 and once the whole chair is assembled, to rotate the anchor 20 clockwise by means of the adjusting screw 27, whereby, the seat and the rods get locked in the desired position, thus, setting the initial resiliency of the seat. 28 is a thrust plate underneath the board to absorb the screw thrust and, rotary joint 29 is a cylinder nested in the anchor that transmits the screw thrust to the anchor regardless of its relative position with the board.

Figure 2:
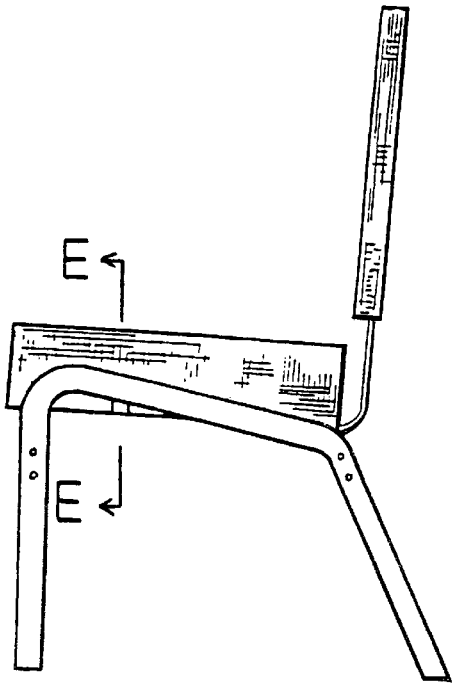
FIG. 2 is a schematic side elevation view of the chair shown in FIG. 1 with the seat in the upright position.
Figure 3:
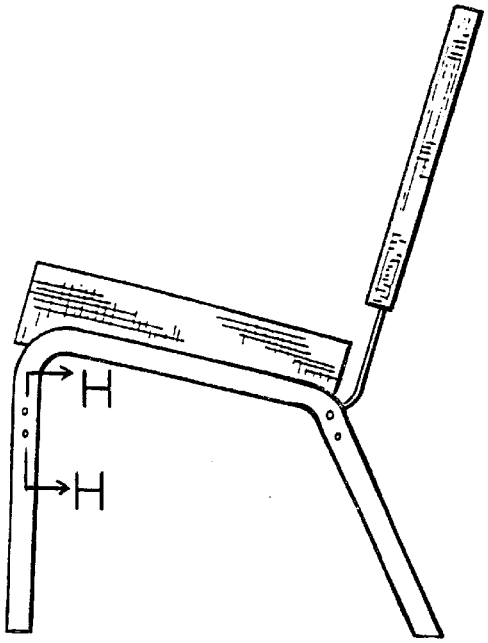
FIG. 3 is a schematic side elevation view of the chair shown in FIG. 1, with the seat in a fully reclined position.
Figure 9:
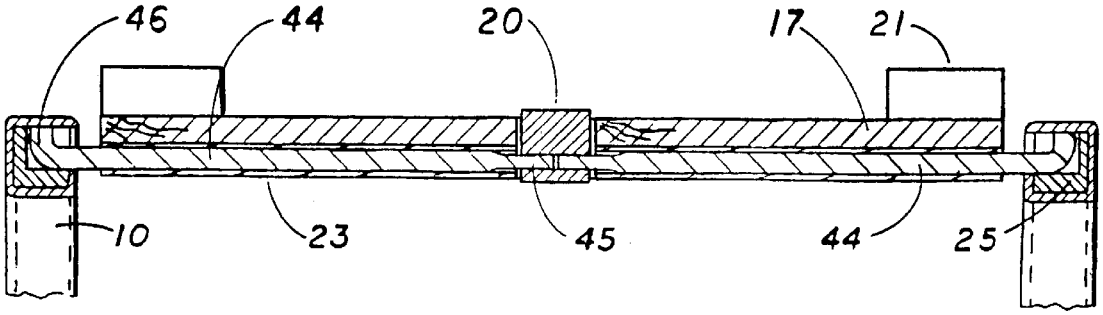
FIG. 9 is a schematic sectional view of the seat of FIG. 4, taken along line C—C, showing another embodiment of the invention.

As it was mentioned above, the ends of bar 18 penetrates inside the horizontal members of the side frames 10, but since the side frames 10 are made of thin wall tubes, no firm anchoring of the torsion bar is possible. To provide a reliable anchoring, a solid metal insert 25, as shown in FIG. 4, FIG. 5 and FIG. 9, was securely placed inside the tube element prior of bending the frames 10. A subsequent machining operation produces a square cavity that would keep the end of the torsion bar 18 firmly in place, plus distributing the torsion moment over a larger area of the tube. In operation, the torsion bar 18 —while supporting the seated person weight— will twist if said person reclines the seat backward; thus, while the ends of bar 18 anchored in the side frames 10 remains immovable, in a nonrotatable relation with said frame, the middle point of the rod, nonrotatable engaged to the adjustable anchor 20 rotates (twist), with the bottom board 17. We now have a seat that will pivot around a virtual axis P—P passing through the center of the torsion bar 18 as shown in FIG. 4, plus a resilient force given by said torsion bar that, in the absence of other forces, would bias the seat toward its maximum forward pivoting position, as shown in the illustration of FIG. 2. In this embodiment, the torsion bar 18 are usually made of a square cross-section medium carbon steel SAE 1045 because of this alloy elastic characteristics though in other possible embodiments other cross-sections including laminated bars, torsion bar ends configurations, alloys or materials could be used without departing from the inventive principle.

FIG. 9 shows one of such other possible embodiment, whereby, the torsion bars are two co-axial cylindrical rods 44, each having its contiguous end machined down to a square key 45, while its outside key is the 90 degree bent end 46. As in a key and keyhole lock arrangement, complementary recessed shapes on the rotatable anchor 20 and inserts 25 provides a firm 'keyhole' anchoring to the bar's keys 45 and 46, respectively.

In other possible embodiments, the torsion bar cross-section and/or its keys could assume the shape of any geometric figure, plus the ends of a bar could be bent without departing from the original concept of providing complementary attaching means to a keyed torsion bar ends. It is obvious by now that in this invention the torsion bar(s) and the seat rotation control means could be contained —and concealed— within the upholstered bottom board, thereby producing an esthetically neat and pleasant looking chair.

In the present manufacturing state-of-the-art, an upholstered bottom seat board is attached to an already assembled chair frame, but this would be hard to do in the present invention where the bottom board has torsion bar ends and seat control means protruding from its sides. Instead, in the present invention the chair frame is assembled 'around' the bottom seat board.

Figure 8:
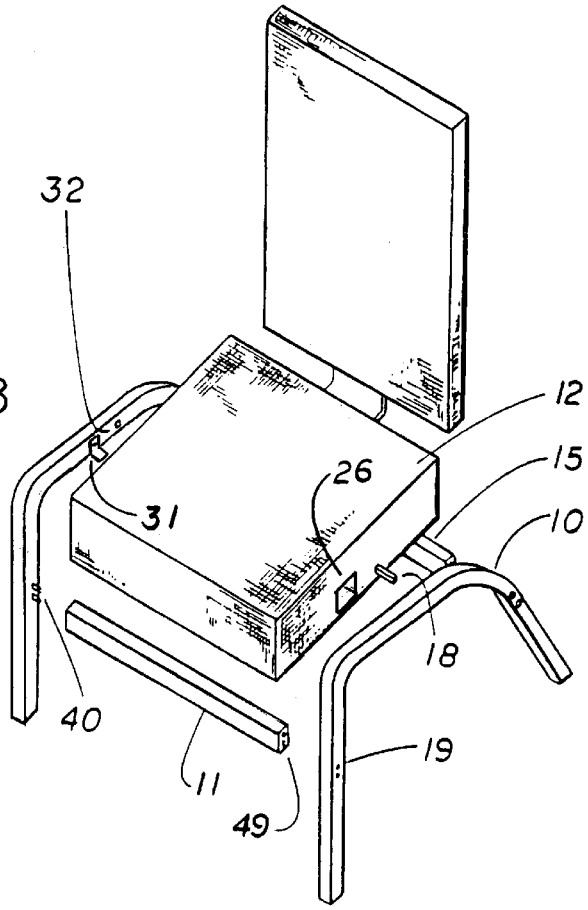
FIG. 8 is an exploded perspective view of the chair shown in FIG. 1.

In FIG. 8 (an exploded perspective view of the chair of FIG. 1), we see how the frame is assembled 'around' the seat board, very securely, fast and inexpensively by using screws that will remain hidden. Because concealing the fastening means is so aesthetically fundamental to a good industrial design, it became one of the main purposes of the present invention.

Moreover, since many of these type of chairs have anodized aluminum frames, it is cheaper to bend, machine, and screw together individual frame components made from long aluminum bars that come already anodized from the mill, than bend, machine and weld together —the same components— that would then have to be carefully anodized and handled as an assembled frame. The manufacturing savings could be substantial, hence, a less expensive chair is possible.

In FIG. 8, the upholstered bottom board seat shows the seat stop bracket 31 and a short length of the square torsion bar 18 protruding from the seat side. Meanwhile, all of the screws 40 needed to assembly the frame 10 legs to the cross-rails 11 and 15 have already been placed into their legs clearance holes 48, and kept in place by jigs and/or fixtures not shown in the illustration.

Finshing the assembly becomes very simple now, we just have to place the loose end of bar 18 into the square hole of insert 32 at the same time that we place the seat stop bracket 31 into the corresponding opening 26. Thereafter, with a suitable tool bit 47 —as shown in phantom lines in FIG. 16— passing through the tool bit access holes 19 we fasten the screws 40 into the corresponding threaded holes 49 existent at the end of the aluminum extruded cross rails 11 and 15. Holes 48 and holes 19 are aligned on opposite walls of the frame legs. Finally, the initial pivoting resilient torque is set by rotating the anchor 20 of FIG. 7, hence, slightly twisting the torsion bar 18. This is accomplished by rotating clockwise the adjusting screw 27, urging the seat to its upright position.

Figure 10:
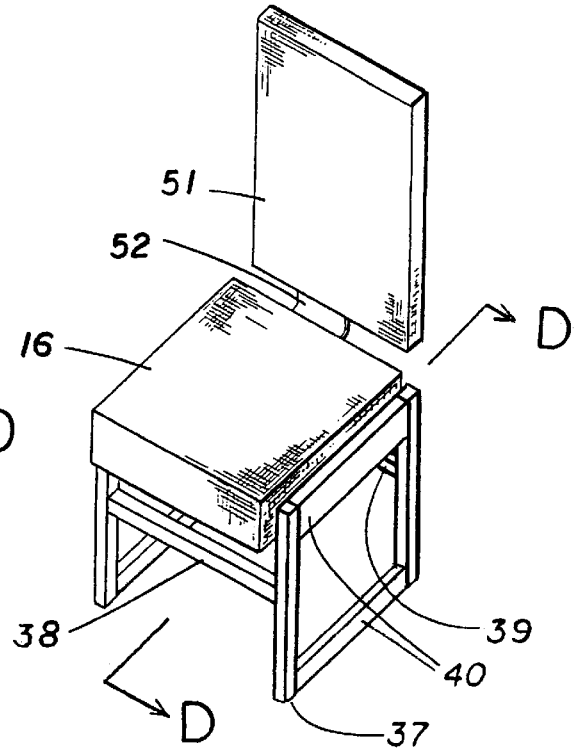
FIG. 10 is a perspective view of a wooden sled framed reclinable four legged chair according to the present invention.
Figure 11:
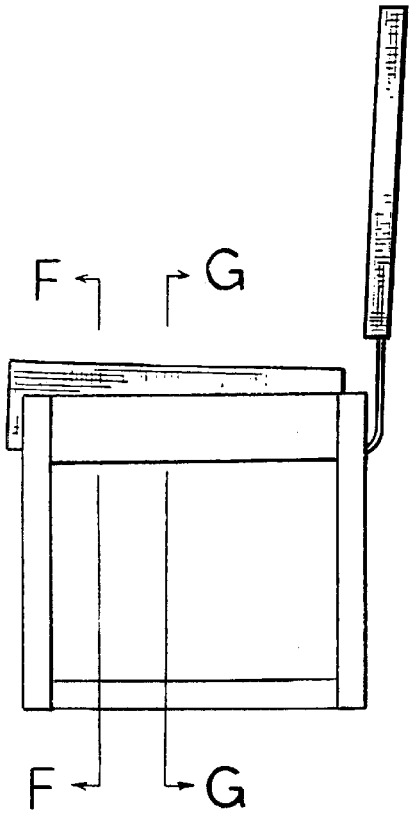
FIG. 11 is a schematic side elevation view of the chair shown in FIG. 10 with the seat in the upright position.
Figures 12, 13:
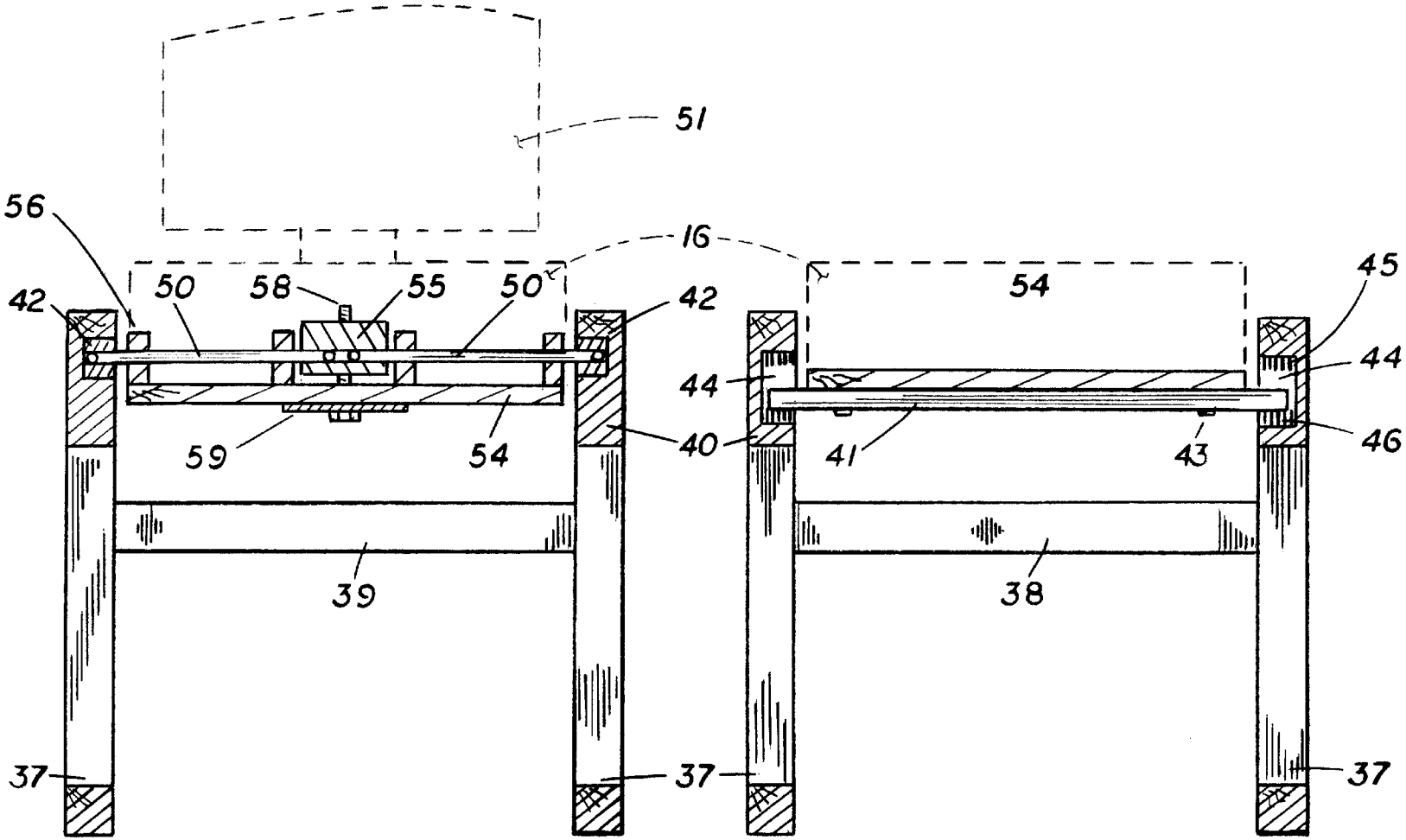
FIG. 12 is a partial view of FIG. 11 taken along line G—G.
FIG. 13 is a partial view of FIG. 11 taken along line F—F.

FIG. 10 is still another embodiment of the present invention in the form of a sled chair having a wooden frame. Here each side frame comprises two identical vertical legs 37 attached to two substantially horizontal members 40. A front cross-rail 38, and a rear cross-rail 39 connect both side frames. The seating comprises an upholstered bottom board 16 and an upholstered back board 51 which are connected together to each other at an obtuse angle by a flat spring 52. It will be understood that the hardware is symmetrically disposed on both side of the chair, hence, the hardware on one side only will be described. In FIG. 12 the two co-axial round torsion bars 50 have bent ends and are engaged to the upper horizontal members 40 by means of metal inserts 42 placed into the wood; said metal inserts have corresponding rectangular holes that will nest the bent ends of said torsion bars. A plurality of bushings 56 attached to the board 54 support and guide the two bars 50, as shown. Here, 55 is the rotatable anchor, 58 is its adjusting screw and, 59 is a thrust plate disposed underneath the board to distribute the screw thrust over a larger area of said board.

Figure 14:
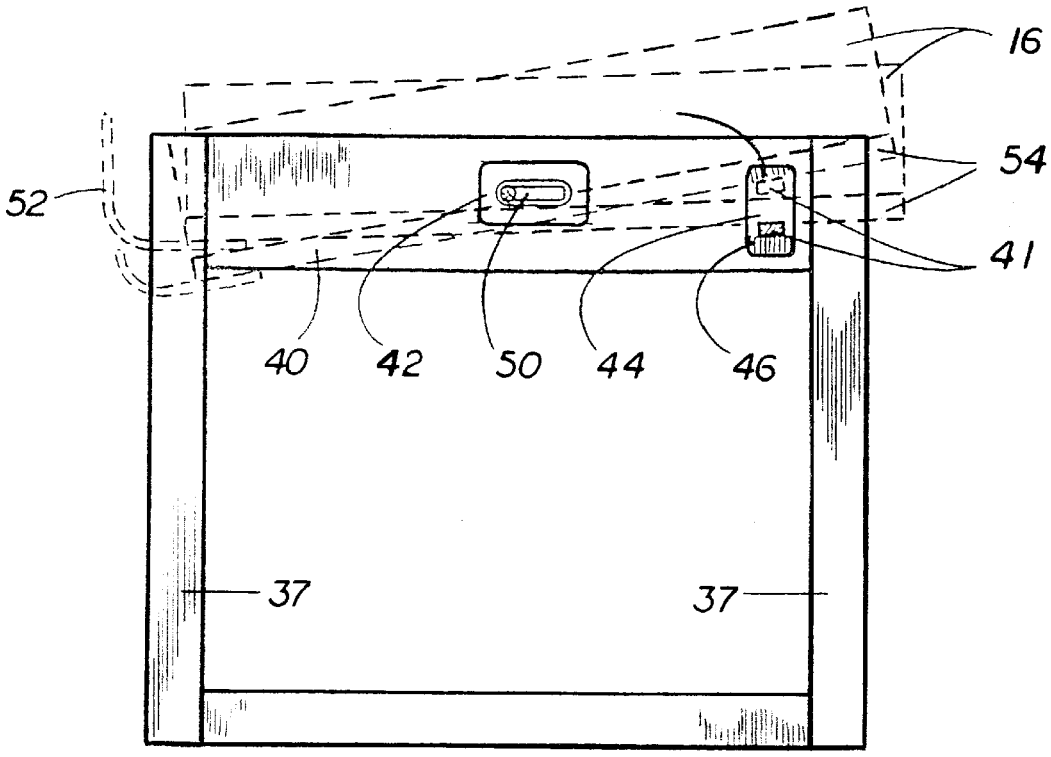
FIG. 14 is a partial view of FIG. 10 taken along line D—D.

In FIG. 13 and in FIG. 14 a seat stop bracket 41, affixed to the underneath of the board 54 by means of fasteners 43, would limit the angle of rotation of said board, that by extension limits the seat travel between its upright and its fully reclined positions. Here, the ends of the bracket 41 extend into cavities 44 that have been machined into the upper horizontal members 40. 45 and 46 are the upper and the lower elastic stops, respectively, for said seat stop bracket 41; said elastic seat stops, made of rubber, are glued to the top and bottom of cavities 44 to elastically limit the travel of said bar, and by extension, the rotation of the chair's seat.

In FIG. 14, 50 is the torsion bar showing its key (the bent end) placed inside insert 42. The two extreme pivoting positions of the upholstered board 16 are shown in phantom lines, and 52 is the flat spring connecting the bottom board 16 to the back board 51 (not shown).

FIG. 15 is another embodiment of the present invention, whereby, the means to limit the rotation of a chair seat are hidden from view by locating them within the upholstered bottom board. Here 10 is the horizontal member of the tubular side frame; the seat stop bracket 31 is attached by fastener 33 to the solid insert 25 that is press fitted inside said tubular side frame. 21 is the elastic seat stop and 24 (shown in dotted lines) is the fastener that attach it to the board 17. 27 is a small metallic shield plate welded to the stop bracket 31 to avoid access to pinch points inside the opening 26. FIG. 15 being a cross-sectional view of the chair of FIG. 2, shows the seat in the upright position. In this position the seat stop bracket 31 stops the elastic seat stop 21 from traveling further down; with the seat in the fully reclined position the stop bracket would be stopped by the lower surface 36 of the block opening 26.

What I claim is:

1. A chair having a reclinable seat comprising in combination two supporting side frames, each having at least one substantially horizontal member and substantially vertical leg members, said frames disposed in a spaced apart relationship by cross-rails; a plurality of travel limiting means placed within said side frames, and a seat mounted between said side frames pivoting about a transverse torsion bar extending between said side frames, and means positioned on said seat engaging said travel limiting means disposed within said side frame members further defining the position of maximum rearward pivoting of the seat and the position of maximum forward pivoting position of the seat, and means for non-rotatably securing the torsion bar at each of its opposite ends to said frames, means for non-rotatably securing the bar at a point intermediate its ends to the seat whereby said torsion bar supports and positions said seat.

2. A chair having a reclinable seat comprising in combination two supporting side frames, each having at least one substantially horizontal member and substantially vertical leg members, said frames disposed in a spaced apart relationship by cross-rails; a plurality of travel limiting means placed within said side frames, and a seat mounted within said side frames for pivoting about a transverse axis defined by resilient means, said seat further comprising an upholstered bottom board, and said resilient means extending between said horizontal members and disposed within said upholstered bottom board; a plurality of bushings placed into said bottom board to hold and guide said resilient means, and adjustable means to nonrotatably lock said resilient means to said bottom board in a desired adjusted position, and complementary anchoring means disposed within said substantially horizontal members for further securing said resilient means in a nonrotatable relation to said side frames, and means positioned on said bottom board for engaging said travel limiting means disposed within said side frame members to define the maximum rearward and the maximum forward positions of the seat, whereby said resilient means urge said seat toward its maximum forward position.

3. A chair as described in claim 2, further comprising a plurality of screw clearance holes in said tubular leg members for a plurality of screws disposed into said holes, and a plurality of tool bits access holes onto said leg members disposed opposite said screws clearance holes, whereby, a tool bit passing through said tool bit access holes could securely attach said frame legs to said cross-rails by fastening the screws to the ends of said cross-rails.

4. In a chair as described in claim 2 whereby, the resilient means comprises a square cross section torsion bar.

5. In a chair as described in claim 2, whereby said resilient means extending between said horizontal members and disposed within said upholstered bottom board further comprises a pair of co-axial torsion bars having keyed ends.

6. In a chair as described in claim 2, whereby said means positioned on said bottom board engaging said travel limiting means disposed within said side frame members further comprising elastic stop means wherein a seat stop bracket mounted on said side frame members is disposed within said elastic stop means.

7. In a chair as described in claim 2, whereby the adjustable means to lock the resilient means to said bottom board in a desired adjusted position further includes a pivotably anchor securely engaged to the resilient means, a thrust plate disposed underneath the bottom board and an adjustable screw connecting said plate to the anchor by mean of a rotary joint.

8. In a chair having a reclinable seat, the combination comprising two tubular frames each having at least a substantially horizontal member and vertical leg members, the frames spatially separated by cross-rails, the seat comprising an upholstered bottom board affixed to an upholstered back board pivoting about two co-axial torsion bars having keyed ends, inserts placed into the horizontal members providing anchorage to outer ends of the torsion bars, located forward of the torsion bars and attached to the seat board are elastic seat stops that engage brackets anchored to the inserts to define the seat maximum forward and rearward pivoting positions, a shield plate in front of the elastic seat stops covering pinch points, and the contiguous ends of the torsion bars engaging adjustable means to lock the bars thereto said bottom board in a nonrotatable desired adjusted position that would resiliently bias the seat toward its maximum forward pivoting position.

* * * * *